US006507972B2

(12) United States Patent
Hart

(10) Patent No.: US 6,507,972 B2
(45) Date of Patent: Jan. 21, 2003

(54) ASSEMBLY OF A CLEANSING DEVICE AND ONE OR MORE CLEANSING ELEMENTS

(76) Inventor: Gerald Leslie Hart, 38 Villiers Avenue, Surbiton, Surrey KT5 8BD (GB)

( * ) Notice: Subject to any disclaimer, the term of this patent is extended or adjusted under 35 U.S.C. 154(b) by 0 days.

(21) Appl. No.: 09/943,484

(22) Filed: Aug. 30, 2001

(65) Prior Publication Data

US 2002/0083542 A1 Jul. 4, 2002

Related U.S. Application Data

(63) Continuation of application No. PCT/IB00/00204, filed on Feb. 25, 2000.

(30) Foreign Application Priority Data

Mar. 1, 1999 (NL) ..... 1011419

(51) Int. Cl.[7] ..... A47K 11/10
(52) U.S. Cl. ..... 15/210.1; 15/104.94
(58) Field of Search ..... 15/104.94, 160, 15/210.1, 257.01; 206/349, 361, 362, 362.1; 294/19.1

(56) References Cited

U.S. PATENT DOCUMENTS

| | | | | |
|---|---|---|---|---|
| 2,528,602 A | | | 11/1950 | Maggit ..... 15/209.1 |
| 2,648,085 A | * | | 8/1953 | Rodgers |
| 3,722,019 A | * | | 3/1973 | Magnien |
| 4,031,673 A | * | | 6/1977 | Hagelberg |
| 4,077,725 A | * | | 3/1978 | Slautterback |
| 4,987,634 A | * | | 1/1991 | Weihrauch |
| 5,323,507 A | * | | 6/1994 | Tosato |
| 5,488,748 A | * | | 2/1996 | Koch |
| 5,630,243 A | * | | 5/1997 | Federico |
| 6,094,771 A | * | | 8/2000 | Egolf et al. |
| 6,158,077 A | * | | 12/2000 | Wenger et al. |
| 6,272,716 B1 | * | | 8/2001 | Thornton |

FOREIGN PATENT DOCUMENTS

| | | |
|---|---|---|
| DE | 3530402 | 6/1986 |
| EP | 295505 | 12/1988 |
| EP | 568250 | 11/1993 |
| GB | 2327185 | 1/1999 |

* cited by examiner

*Primary Examiner*—Terrence R. Till
(74) *Attorney, Agent, or Firm*—Ostrolenk, Faber, Gerb & Soffen, LLP

(57) ABSTRACT

Assembly of a cleansing device and one or more substantially flat cleansing elements for single use, in particular intended for the cleansing of a toilet bowl, the cleansing device comprising at least a handle with a head, while the cleansing elements are provided on one side, at least locally, with an adhesive for temporarily attaching the cleansing element to the head of the cleansing device, in which assembly the cleansing device comprises release means for releasing the cleansing element after use.

9 Claims, 4 Drawing Sheets

ASSEMBLY OF A CLEANSING DEVICE AND ONE OR MORE CLEANSING ELEMENTS

CROSS-REFERENCE TO RELATED APPLICATION

This is a continuation application of PCT/IB00/00204 filed Feb. 25, 2000, which PCT application claims priority of NL Application number NL-1011419 filed Mar. 1, 1999.

FIELD OF THE INVENTION

The present invention relates firstly to an assembly of a cleansing device and one or more substantially flat cleansing elements for single use, in particular intended for the cleansing of a toilet bowl, the cleansing device comprising at least a handle with a head, while the cleansing elements are provided on one side, at least locally, with an adhesive for temporarily attaching the cleansing element to the head of the cleansing device, wherein the cleansing device comprises release means for releasing the cleansing element after use.

BACKGROUND OF THE INVENTION

An assembly of this nature is known, for example, from GB-A-2 327 185. This British patent application describes a toilet-cleansing unit which comprises a handle with a head, to which head a cleansing element can be releasably attached. The cleansing elements are stacked in a holder which is intended for this purpose, and both the head and the cleansing elements are provided with an adhesive. When the cleansing device is moved into the holder for cleansing elements, the top cleansing element is automatically attached to the head of the cleansing device.

The cleansing elements all comprise a projecting lip, by means of which the cleansing element can be removed manually from the head after use. If the cleansing device with a cleansing element attached has been used for cleansing a toilet bowl, it is undesirable, for hygiene reasons, for the cleansing. element to be removed from the cleansing device manually with the aid of the said lip and deposited, for example, in the toilet.

Therefore, in the prior art there is a demand for improved assemblies of cleansing devices with cleansing elements which do not have the above drawbacks.

SUMMARY OF THE INVENTION

The object of the present invention is to provide an assembly of this nature. To this end the invention is characterized, in a first embodiment, in that the release means comprise manually actuable ejector pins in the head. In an alternative embodiment the invention is characterized in that the release means are designed in the form of a manually deformable section of the head. The use of release means according to one of the two alternative embodiments of the present invention in the cleansing device has the advantage that the cleansing elements no longer have to be touched by the user after they have been used. Moreover, with the assembly according to the invention it will be possible to release the used cleansing element from the cleansing device while the element is still in the toilet bowl or the like. This has the additional advantage that it is not necessary for the entire device including the used cleansing elements to be lifted well above the toilet bowl in order for the cleansing element to be removed. If a cleansing device is lifted out of the toilet bowl after use, liquid residues of contaminants from the toilet bowl may be transferred to the outside of the toilet bowl, the toilet seat, the floor or the clothing of the user.

The ejector pins are preferably coated with a release agent such as for example Teflon. These ejector pins can be actuated by means of a pull rod or push rod in the handle of the cleansing device. This embodiment will be explained in more detail below in the description of the figures.

If the release means are designed in the form of a manually deformable section of the head, for example, if the head is made from flexible material, it is possible, likewise by using a push rod or pull rod, to deform the head of the cleansing device after the cleansing device has been used, so that the cleansing element is released from the head.

In particular, the cleansing elements on the other side are designed in such a manner that this side has a release action for the adhesive. This means that when the cleansing elements are stacked in a suitable manner, the adhesive of a bottom cleansing element cannot stick to a cleansing element lying above it. Consequently, the operation of attaching a cleansing element to a cleansing device according to the invention is not obstructed by the presence of the remaining cleansing elements located beneath it.

In particular, the release agent, which during use is situated on the cleansing side of the cleansing element, may comprise agents which are desired for cleansing. For example, the release agent may comprise a cleansing agent or the like, for example in the form of microcapsules incorporated in the release agent. It is also possible for the release agent itself to promote the cleansing action by being designed as, for example, a rough, ribbed or corrugated surface. Other known release agents, such as types of wax, may also be used. The release agent may also contain water-soluble dyes which indicate to the user which cleansing step is to be carried out.

The adhesive is not particularly limited and is advantageously selected from water-soluble adhesives, pressure-sensitive adhesives, adhesives with an adhesive force which decreases over the course of time. The latter adhesives may be multicomponent adhesives, one of the components of which is contained in the other, for example in breakable microcapsules. During use, the microcapsules will be opened and the adhesive action which decreases over the course of time will be obtained.

Particularly preferably, the adhesive is a pressure-sensitive acrylic or silicone adhesive, most preferably an acrylic adhesive which is applied as a 50% solids emulsion in the form of a printed pattern which is cured by UV light.

In a particular embodiment of the invention, the adhesive is applied to the cleansing element in a grid pattern. For this purpose, consideration may be given, for example, to application by printing.

The invention also provides a cleansing device specifically intended for an assembly according to the invention.

The invention also provides a cleansing element specifically intended for an assembly according to the invention.

The cleansing elements according to the invention are not particularly limited, but preferably comprise water-soluble or water-dispersible materials, such as for example cardboard, paper or papier mache. Other fibrous materials, such as cotton, synthetic fibres, felt, but also foam, film material and the like, are also suitable. In other words, it is preferable for the material of the cleansing element to be selected in such a manner that this element can be flushed away by the toilet after use. In particular, the material of the cleansing element according to the invention is biodegradable and thus environmentally friendly.

Preferably, the cleansing element according to the invention comprises cardboard with a thickness of 2–3 mm and a weight of 800–1200 g/m$^2$.

The cleansing elements may be impregnated with cleansing agents or other substances required for cleansing.

Finally, the invention provides a stack of cleansing elements in which the cleansing elements are arranged in such a manner that the side of the cleansing element which does not bear adhesive bears against the side of a subsequent cleansing element which does bear adhesive.

BRIEF DESCRIPTION OF THE DRAWINGS

The invention will be explained in more detail below with reference to the appended drawing, in which.

DESCRIPTION OF THE PREFERRED EMBODIMENT

Figure 1D:
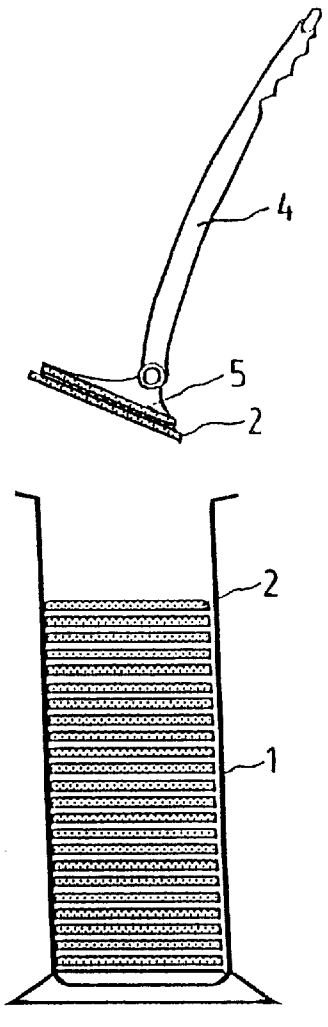
FIGS. 1*a–d* diagrammatically depict steps of the functional principle of an assembly according to the invention during attachment of a cleansing element to the head of the cleansing device.
Figure 1C:
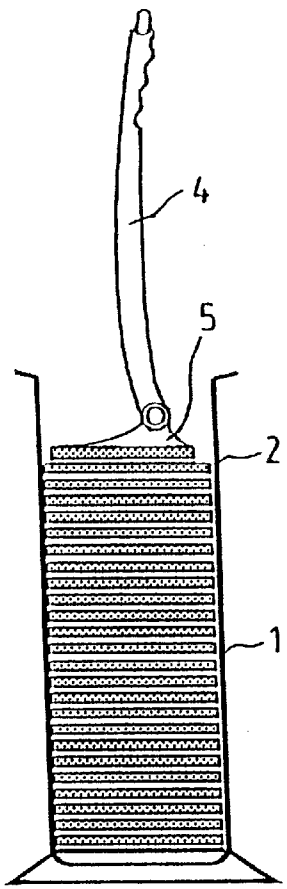
Figure 1B:
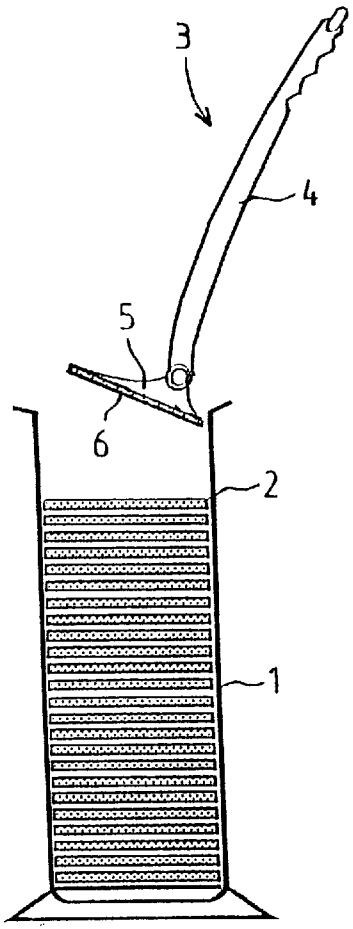

In FIGS. 1*a–d*, the general principle of the assembly according to the invention is shown in steps. In FIGS. 1*a–d*, 1 denotes a holder in which a stack of cleansing elements 2 according to the invention can be placed, each cleansing element 2 being provided with an adhesive on the top side.

A cleansing device according to the invention is denoted by 3 and comprises a handle 4 and a head 5. In this case, the head 5 comprises a smooth attachment surface 6.

Figure 1A:
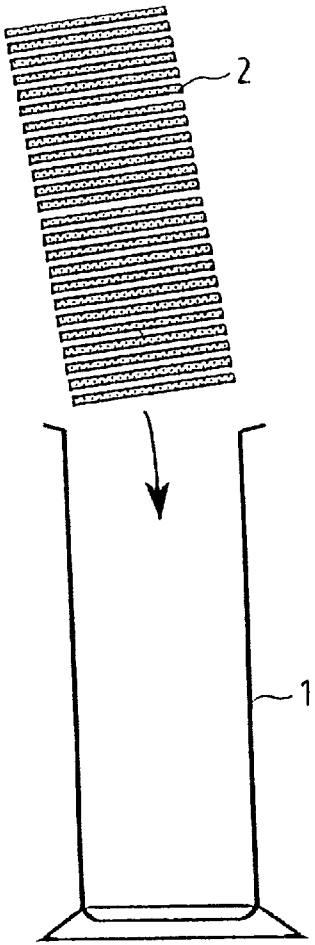

FIG. 1*a* indicates how a stack of cleansing elements is placed in the holder 1. Then, in FIG. 1*b* and FIG. 1*c* a cleansing device 3 is introduced into the holder 1 onto the top cleansing element 2, so that the attachment surface 6 of the head 5 is brought into contact with that side of a cleansing element 2 on the top of the stack, which is provided with an adhesive.

In FIG. 1*d*, it can be clearly seen how a cleansing element 2 is attached to a cleansing device 3.

With regard to the manner of stacking and possible choice of adhesives, reference is also made to WO-A-89/00385.

The choice of adhesive may be such that the adhesive, after it comes into contact with water, loses its adhesive power after a certain time, so that the cleansing element is easy to remove from the head 5 of the cleansing device 3.

Figure 2A:
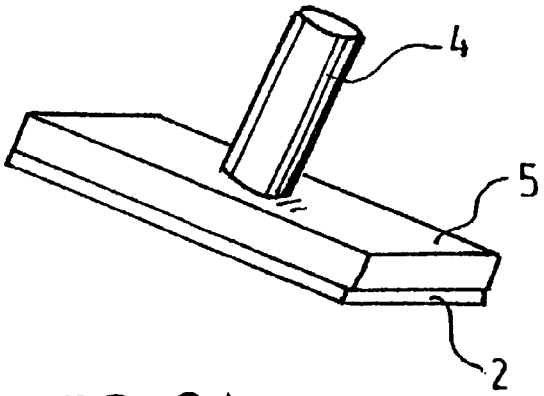
FIGS. 2*a–d* depict steps illustrating the functional principle of release means for use in the present cleansing assembly according to the invention.

FIGS. 2*a–d* provide a highly diagrammatic illustration of an example of release means in the head 5. In FIG. 2*a*, the head 5 has already been provided with a cleansing element 2. Only one section of the handle 4 is shown. In the handle there is a mechanism which is able to actuate ejector pins 7. By way of example, consideration may be given to a push rod or a pull rod.

Figure 2B:
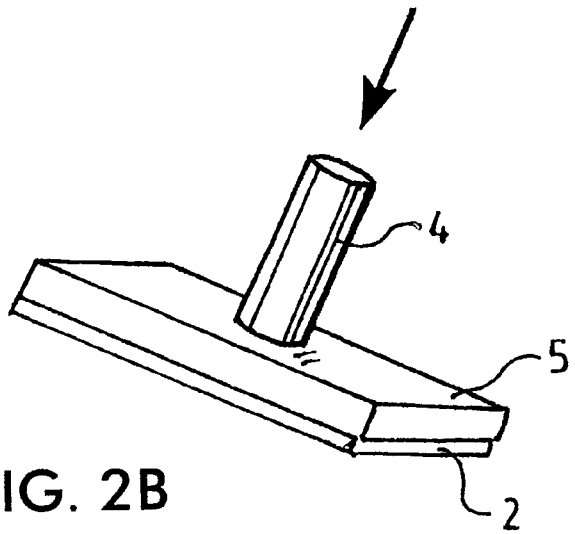
Figure 2C:
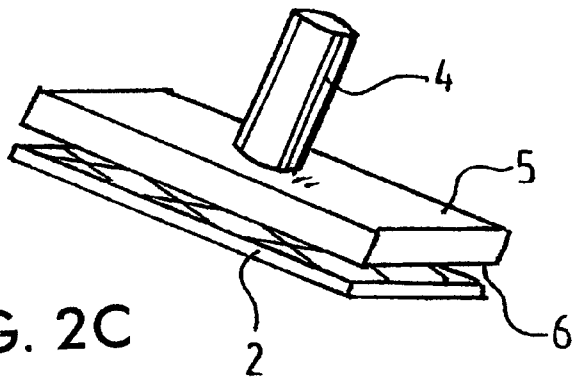
Figure 2D:
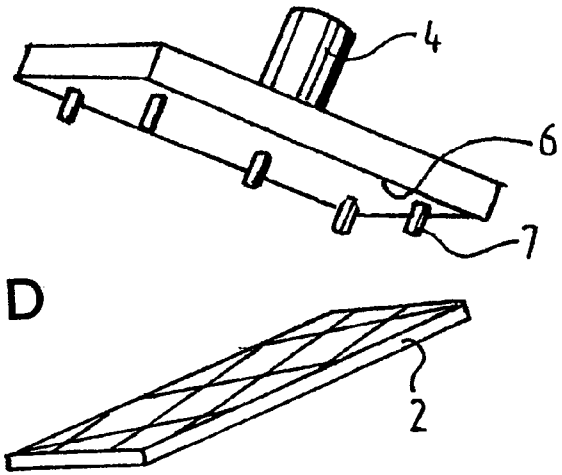

It is shown in FIGS. 2*a* and 2*b* that by pressing the push-rod in the direction of the arrow the ejector pins can be pressed out of the attachment surface 6 of the head 5 in order to release the cleansing element 2 from the head. In FIG. 2*d*, the cleansing element 2 has been released altogether.

It will be clear that a very large number of other release means are equally suitable. Consideration may be given, for example, to release by means of local deformation of the head of the cleansing device. This may, if appropriate, likewise be brought about using a pull rod or push rod which is connected to suitable means in the head.

Figure 3C:
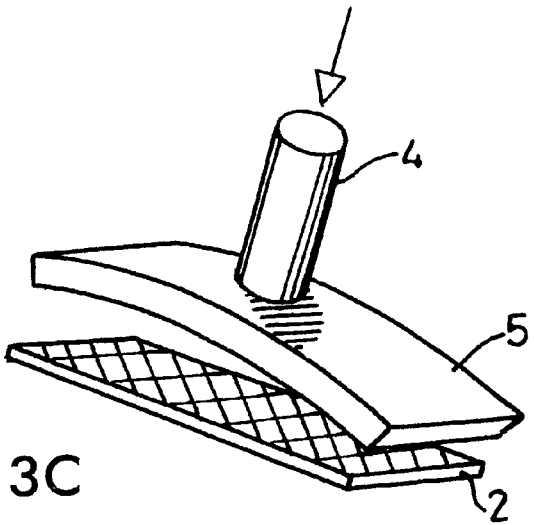
FIGS. 3*a–d* show steps illustrating the functional principle of another embodiment of release means according to the invention.
Figure 3D:
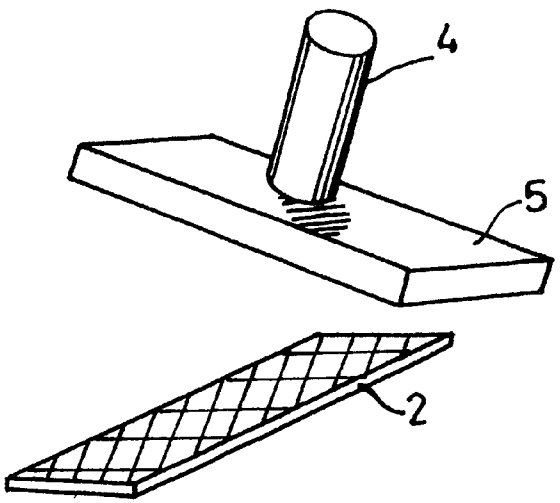
Figure 3A:
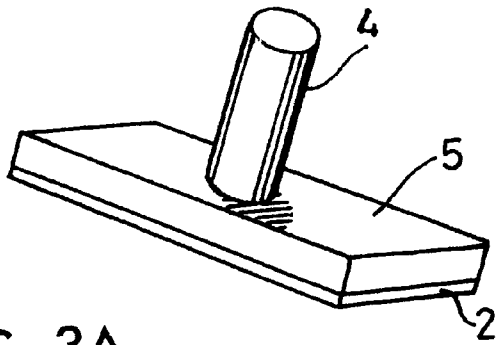
Figure 3B:
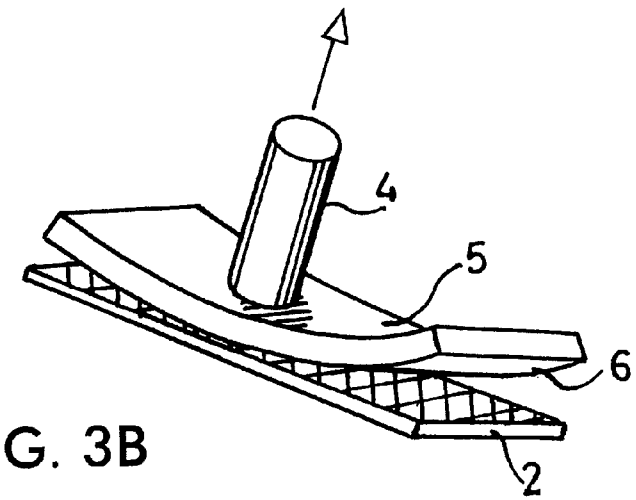

Release means of this nature are shown in FIGS. 3*a–d*. By means of a suitable mechanism in the handle 4, for example once again a push rod or pull rod, it is possible, as shown in FIG. 3b and FIG. 3c, to deform the head 5 of the cleansing device in two directions. This deformation in two directions makes it possible to release the cleansing element 2 from the head 5. Preferably, in this embodiment the head 5 is made from elastic material or from parts which are hingedly connected to one another. The functional principle of these release means is based on the fact that, when the head is deformed, the size of the surface of the head is increased or reduced at the location where the latter interacts with the cleansing element.

Figure 4C:
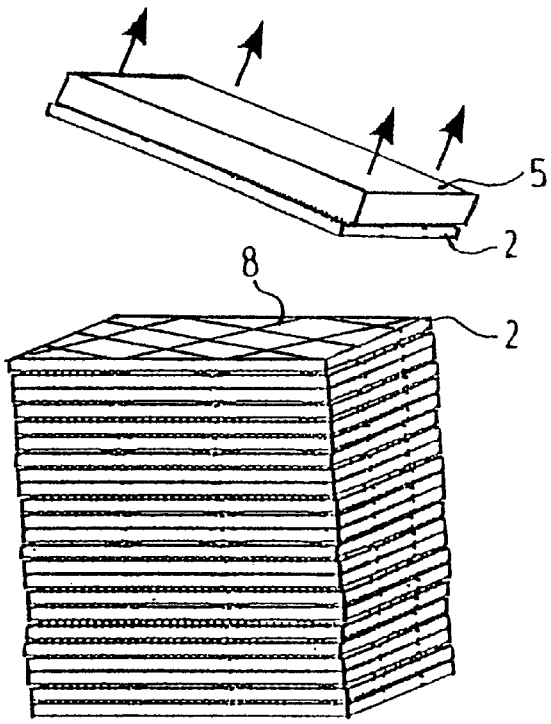
FIGS. 4*a–c* diagrammatically depict the functional principle using cleansing elements with an adhesive on one side and a release agent on the other side.
Figure 4B:
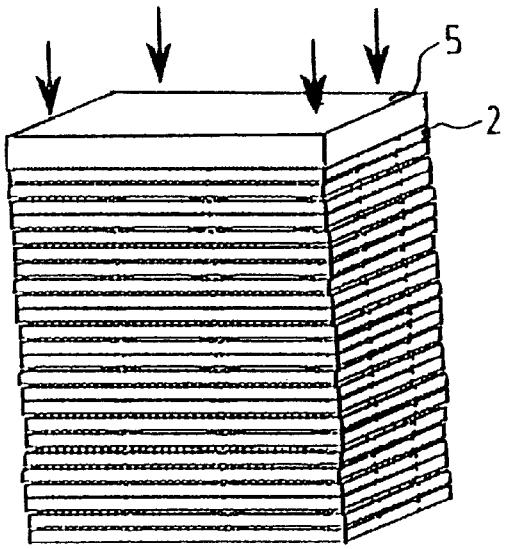
Figure 4A:
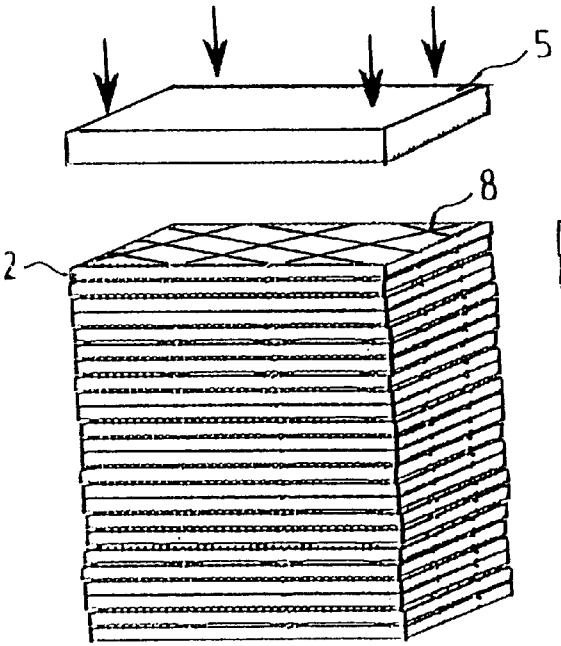

FIGS. 4*a–c* a stack of cleansing elements, each cleansing element being provided on one side with an adhesive 8 printed in a pattern. On the other side, the cleansing elements are provided with a release agent which substantially does not stick to the adhesive 8. The releasing action can be enhanced further by, for example, making the said side likewise corrugated, which also assists with the cleaning action when the assembly is being used. The arrow in FIGS. 4*a–c* show the sequential movement of the head 5 to pick up a cleansing element from the stick.

Preferably, the cleansing element is designed in such a manner that it maintains its cohesion for approximately 10 minutes in the wet state. If appropriate, the adhesive side may be reinforced with a resin or plastic.

It will be clear that the shape of the handle and the head, and the shape of the cleansing elements are not limited in any way, but the essential factor of the assembly according to the invention is that with the aid of the cleansing device a cleansing element can be attached thereto in a simple manner without unnecessary additional actions with unsecure attachment being required.

Preferably, the outside dimension of the cleansing elements is slightly greater than that of the attachment surface of the head of the cleansing device.

What is claimed is:

1. An assembly of a cleaning device and one or more substantially flat cleansing elements for single use for the cleansing of a toilet bowl, the cleaning device comprising a handle with a head, the cleansing elements have one side provided at least locally with an adhesive for temporarily attaching the cleansing element to the head of the cleansing device, wherein the cleansing device comprises manually actuable ejector pins in the head for releasing the cleansing element after use.

2. The assembly according to claim 1, wherein the cleansing elements have another side that has a releasing action for the adhesive.

3. The assembly according to claim 1, wherein the adhesive is selected from the group consisting of water-soluble adhesives, pressure-sensitive adhesives, and adhesives with an adhesive force which decreases over the course of time.

4. The assembly according to claim 1, wherein the adhesive is applied to the cleansing element in a grid pattern.

5. The assembly of claim 1, wherein the stack of cleansing elements have another side which is without the adhesive, and the cleansing elements are arranged such that the other side of each of the cleansing elements which does not bear the adhesive bears against the one side of a subsequent cleansing element which does not bear the adhesive.

6. An assembly of a cleansing device and one or more substantially flat cleansing elements for single use for the cleansing of a toilet bowl, the cleansing device comprising a handle with a head, the cleansing elements have one side provided at least locally with an adhesive for temporarily attaching the cleansing element to the head of the cleansing device, wherein the cleansing device comprises a manually deformable section of the head for releasing the cleansing element after use.

7. The assembly according to claim 6, wherein the cleansing elements have another side that has a releasing action for the adhesive.

8. The assembly according to claim 6, wherein the adhesive is selected from the group consisting of water-soluble adhesives, pressure-sensitive adhesives, and adhesives with an adhesive force which decreases over the course of time.

9. The assembly according to claim 6, wherein the adhesive is applied to the cleansing element in a grid pattern.

* * * * *